US006796133B2

(12) United States Patent
Park

(10) Patent No.: US 6,796,133 B2
(45) Date of Patent: Sep. 28, 2004

(54) METHOD FOR CONTROLLING OPERATION OF REFRIGERATOR

(75) Inventor: Jin Koo Park, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/356,615

(22) Filed: Feb. 3, 2003

(65) Prior Publication Data

US 2004/0016254 A1 Jan. 29, 2004

(30) Foreign Application Priority Data

Jul. 24, 2002 (KR) ..... 10-2002-0043609

(51) Int. Cl.[7] ..... F25B 1/00
(52) U.S. Cl. ..... 62/115; 62/229; 236/91 A
(58) Field of Search ..... 236/91 A, 91 R, 236/78 D; 62/229, 115

(56) References Cited

U.S. PATENT DOCUMENTS 5,524,447 A * 6/1996 Shim ..... 236/91 R X
6,526,770 B1 * 3/2003 Tang et al. ..... 62/229

* cited by examiner

*Primary Examiner*—Harry B. Tanner
(74) *Attorney, Agent, or Firm*—Birch, Stewart, Kolasch & Birch, LLP

(57) ABSTRACT

Method for controlling operation of a refrigerator including the steps of turning on a compressor when a temperature of a food storage chamber reaches to an upper limit of upper/lower temperature deviations ΔT from an optimal setting temperature T, turning off the compressor when the temperature of the food storage chamber reaches to a lower limit of upper/lower temperature deviations ΔT from the optimal setting temperature T, and varying the upper/lower temperature deviations ΔT with an outside temperature.

4 Claims, 3 Drawing Sheets

METHOD FOR CONTROLLING OPERATION OF REFRIGERATOR

This application claims the benefit of the Korean Application No. P2002-43609, filed on Jul. 24, 2002, which is hereby incorporated by reference.

BACKGROUND OF THE INVENTION

1. Field of the Invention

The invention relates to a method for controlling operation of a refrigerator, and more particularly, to a method for controlling operation of a refrigerator compressor.

2. Background of the Related Art

A refrigerator is used for the long time fresh storage of food. In general, the refrigerator is provided with a food storage chamber for storing food in a frozen, or refrigerated state, and various components for carrying out a refrigerating cycle to cool down the food storage chamber. Among the key components for carrying out a refrigerating cycle, there are a compressor for compressing the refrigerant, a condenser for isobaric condensing of the compressed refrigerant, an expanding device for adiabatic expansion of the compressed refrigerant, and an evaporator for isobaric evaporation of the expanded refrigerant.

In the meantime, the refrigerator cools down the food storage chamber as the refrigerant circulates through the compressor, the condenser, the expanding device, the evaporator, and the compressor in succession. Once the food storage chamber is cooled down below a preset temperature as the compressor is driven for a time period, the compressor is stopped to stop circulation of the refrigerant, to stop the cooling down of the food storage chamber. If the compressor is stopped for a certain time period, the temperature of the food storage chamber rises, and if the temperature of the food storage chamber rises above a preset temperature, the compressor comes into operation, to cool down the food storage chamber again.

FIGS. 1 and 2 illustrate graphs each showing an example of a method for controlling operation of a compressor in a related art refrigerator carried out as above. Related art methods for controlling operation of a compressor in a refrigerator will be explained, with reference to FIGS. 1 and 2.

Referring to FIG. 1, the compressor is controlled to turn on/off repeatedly so that the temperature of the food storage chamber is within preset upper/lower temperature deviations (hereafter called as "ΔT") from a preset optimal set temperature (hereafter called as "T"). That is, when the temperature of the food storage chamber reaches to an upper limit of T±ΔT, the compressor is turned on to drop the temperature of the food storage chamber, and when the temperature of the food storage chamber reaches to a lower limit of T±ΔT, the compressor is turned off to leave the temperature of the food storage chamber to rise, thereby controlling the temperature of the food storage chamber to be within T±ΔT. In this instance, the "T" is required for prevention of the compressor from being turned on/off too frequently.

In more detail, referring to FIG. 2, in the related art, a method for controlling turn on/off the compressor is used so that the temperature of the food storage chamber is to be within T±ΔT according to the upper/lower temperature deviations ΔT (1) fixed regardless of an external temperature variation with reference to an optimal set temperature 'T' required at the food storage chamber.

Consequently, while the turn on/off time period 2 is the shortest when an outside temperature is at a standard temperature (a temperature in a range of 20° C.~30° C.); the turn on/off time period is long when the outside temperature is higher or lower then the standard temperature because the turn off time period 4 of the compressor is long when the outside temperature is lower than the standard temperature owing to a reduced heat load of the refrigerator, and the turn on time period 3 of the compressor is long when the outside temperature is higher than the standard temperature owing to an increased heat load of the refrigerator.

In the meantime, 'T' is inversely proportional to a freshness of food. That is, the higher the 'T', the lower the freshness of the food because the temperature of the food storage chamber varies in a great range with reference to 'T', and the lower the 'T', the higher the freshness of the food because the temperature of the food storage chamber varies in a small range with reference to 'T'.

However, as explained, setting the 'T' too low for improvement of the freshness of the food causes too frequent turn on/off of the compressor, that degrades performance and lifetime of the compressor.

SUMMARY OF THE INVENTION

Accordingly, the present invention is directed to a method for controlling operation of a refrigerator that substantially obviates one or more of the problems due to limitations and disadvantages of the related art.

An object of the present invention is to provide a method for controlling operation of a refrigerator, which can improve freshness of food stored therein while performance and lifetime of a compressor thereof are improved.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for controlling operation of a refrigerator including the steps of turning on a compressor when a temperature of a food storage chamber reaches to an upper limit of upper/lower temperature deviations ΔT from an optimal setting temperature T, turning off the compressor when the temperature of the food storage chamber reaches to a lower limit of upper/lower temperature deviations ΔT from the optimal setting temperature T, and varying the upper/lower temperature deviations ΔT with an outside temperature.

The variation of the upper/lower temperature deviations ΔT for a range of the outside temperature higher or lower than a standard temperature (a temperature set between 20° C.~30° C.) is set smaller than the variation of the upper/lower temperature deviations ΔT for a range of the outside temperature at the standard temperature.

The variation of the upper/lower temperature deviations ΔT for a range of the outside temperature higher or lower than a standard temperature range (a temperature range of 20° C.~30° C.) is set smaller than the variation of the upper/lower temperature deviations ΔT for a range of the outside temperature at the standard temperature.

The upper/lower temperature deviations are set such that the turn on/off period of the compressor is maintained constant regardless of the outside temperature.

The method further includes the step of making realtime monitoring of the turn on/off period of the compressor, and finding optimal upper/lower temperature deviations which can maintain the turn on/off period of the compressor constant and setting to a microcomputer.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In explaining the present invention, the same parts will be given the same names and symbols, and iterative explanations of which will be omitted.

Though upper/lower temperature deviations 'ΔT' of a food storage chamber are fixed with reference to an optimal preset temperature 'T' regardless of an outside temperature in the related art, the present invention suggests varying the upper/lower temperature deviations 'ΔT' of a food storage chamber with an outside temperature in a reducing trend for improving freshness of food, which will be explained in detail with reference to FIG. 3.

Figure 3:
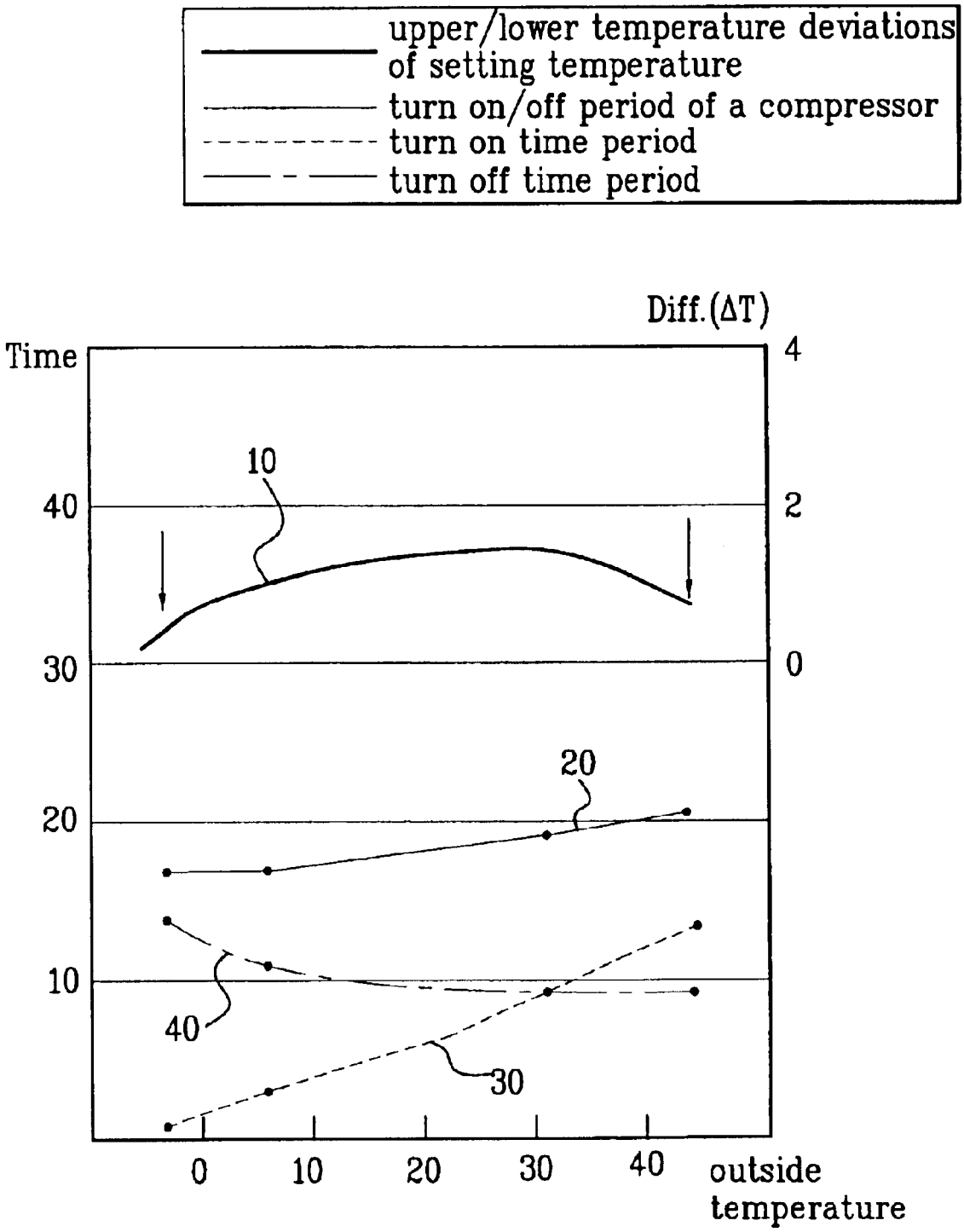

Referring to FIG. 3, the method for controlling operation of a refrigerator includes the steps of turning on a compressor if a temperature of a food storage chamber reaches to an upper limit of upper/lower temperature deviations 'ΔT' 10 from an optimal setting temperature 'T', turning off the compressor if the temperature of the food storage chamber reaches to a lower limit of upper/lower temperature deviations 'ΔT' 10 from an optimal setting temperature 'T', and varying the upper/lower temperature deviations 'ΔT' 10 with an outside temperature. The upper/lower temperature deviations 'ΔT' varying with the outside temperature may be set on a microcomputer (not shown) for controlling the compressor.

In this instance, referring to FIG. 3, the upper/lower temperature deviations 'ΔT' 10 are varied such that the upper/lower temperature deviations 'ΔT' 10 set at a temperature range higher or lower than the standard temperature (a temperature set between 20° C.~30° C.) are smaller than the upper/lower temperature deviations 'ΔT' 10 set at the standard temperature.

Though a reference of the variation of the upper/lower temperature deviations 'ΔT' 10 may be set to be the standard temperature (a temperature set between 20° C.~30° C.), the reference may be set to be a wide range, i.e., a standard temperature range (a temperature range of 20° C.~30° C.).

By controlling the compressor according to the foregoing method of the present invention, keeping the upper/lower temperature deviations 'ΔT' 10 as it is when the outside temperature falls on the standard temperature or the standard temperature range, and reducing the upper/lower temperature deviations 'ΔT' 10 when the outside temperature falls on a range outside of the standard temperature or the standard temperature range, a freshness of the food stored in the food storage chamber is improved. The freshness of the food is improved because the temperature of the food storage chamber is always maintained constant in the vicinity of the optimal setting temperature 'T' as the upper/lower temperature deviations 'ΔT' 10 are reduced.

Referring to FIG. 3, when the compressor is controlled by the method of the present invention, though the turn on/off period of the compressor becomes significantly shorter than the related art, the performance of the compressor is not influenced. Because the method for controlling operation of a compressor of the present invention reduces the upper/lower temperature deviations 'ΔT' 10, not in a case the turn on/off period 20 of the compressor is the shortest, i.e., when the outside temperature falls on the standard temperature or the standard temperature range, but in a case the turn on/off period 20 of the compressor is long, i.e., when the outside temperature falls on a range higher or lower than the standard temperature or the standard temperature range, as shown in FIG. 3, the turn on/off period of the compressor is not shortened than the related art minimum turn on/off period 20.

Referring to FIG. 3, in the method for controlling operation of a compressor of the present invention, it is preferable that the upper/lower temperature deviations 'ΔT' 10 are varied such that the turn on/off period 20 of the compressor is maintained constant regardless of the outside temperature, for improvement of the performance and lifetime of the compressor.

For varying the upper/lower temperature deviations 'ΔT' 10 such that the turning on/off period 20 of the compressor is maintained constant regardless of the variation of the outside temperature, the turning on/off period 20 of the compressor may be real time monitored, to find optimal upper/lower deviation 10 which can maintain the turning on/off period 20 of the compressor constant, and set on the microcomputer.

The method for controlling operation of a refrigerator compressor of the present invention will be explained in comparison to the related art method, with reference to FIGS. 2 and 3.

Figure 1:
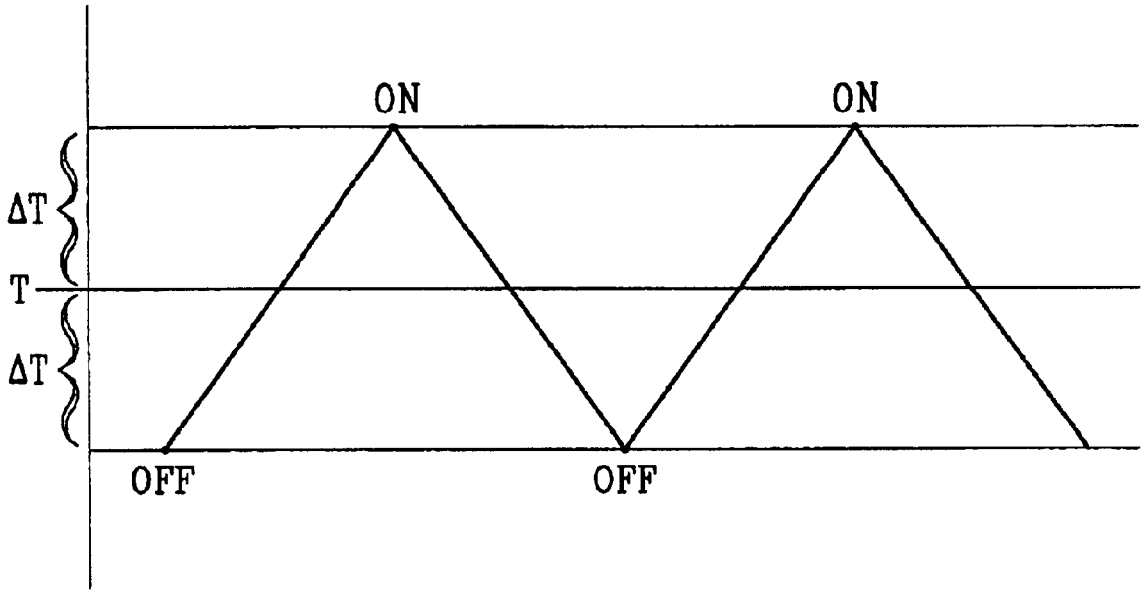
FIG.1 Prior Art
FIG. 1 illustrates a graph showing relations of a temperature of a food storage chamber and turn on/off control of a compressor according to a related art method for controlling operation of a compressor.
Figure 2:
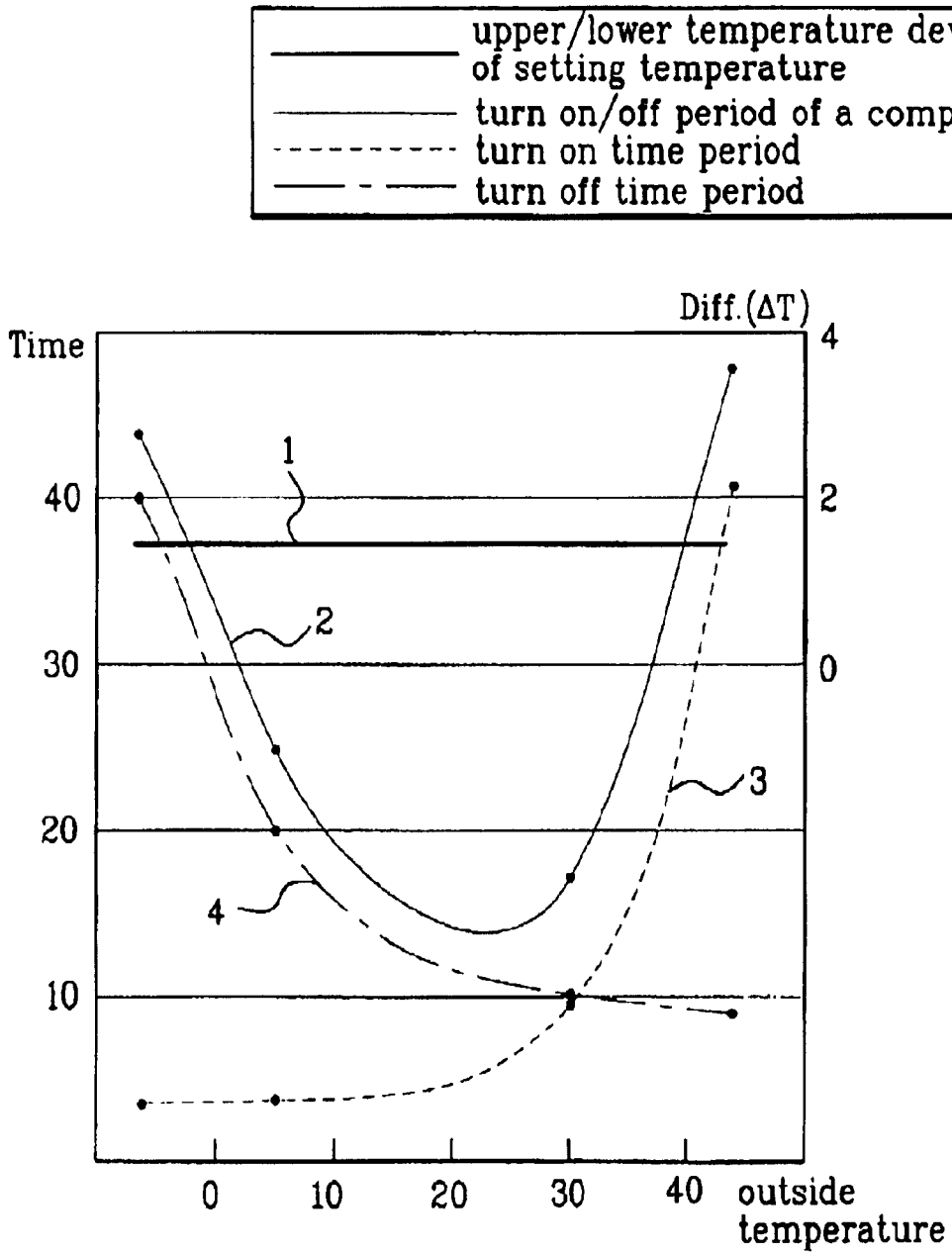
FIG.2 Related Art
FIG. 2 illustrates a graph showing turn on/off control frequencies of the compressor versus an outside temperature, time, and upper/lower deviations from an optimal temperature of a food storage chamber according to a related art method for controlling operation of a compressor; and, FIG. 3 illustrates a graph showing turn on/off control frequencies of the compressor versus outside temperature, time, and upper/lower deviations from an optimal temperature of a food storage chamber according to a method for controlling operation of a compressor in accordance with a preferred embodiment of the present invention.

Referring to FIG. 2, when an heat load on the refrigerator is increased due to the outside temperature higher than the standard temperature or the standard temperature range, though the turning on time period 3 of the compressor increases and the turning of time period 4 of the compressor reduces, a total turning on/off time period 2 increases substantially. In this instance, since the upper/lower temperature deviations ΔT 1 do not change, the improvement of freshness of the food can not be expected.

Opposite to this, in the method for controlling operation of a refrigerator compressor of the present invention, since, after providing optimal upper/lower temperature deviations ΔT 10 which can maintain the turning on/off period 20 of the compressor constant to the microcomputer continuously, the compressor is controlled according to the varied upper/lower temperature deviations ΔT 10, the turn on/off period 20 can be maintained almost constant, by reducing the upper/lower temperature deviations ΔT 10, and reducing the turned on time period 30 and increasing the turned off time period 40. Since such a control reduces the upper/lower temperature deviations ΔT 10, the freshness of the food can be improved.

Referring to FIG. 2, in the related art method for controlling a compressor, when the heat load on the refrigerator is reduced as the outside temperature drops to be lower than the standard temperature or the standard temperature range, the turn on time period 3 of the compressor is reduced, and the turn off time period 4 of the compressor is increased, to make a total turn on/off time period 2 longer. In this instance, since the upper/lower temperature deviations 1 are not changed, the improvement of the freshness of the food can not be expected.

Opposite to this, in the method for controlling operation of a compressor of the present invention, since the compressor is controlled according to the upper/lower temperature deviations ΔT 10 varied as optimal upper/lower temperature deviations ΔT 10 that can maintain the turn on/off time period 20 of the compressor constant are provided to the microcomputer, which reduces the upper/lower temperature deviations ΔT 10 and increases the turn on time period 30 of the compressor and reduces the turn off time period 40 of the compressor, the turn on/off time period 20 can be maintained almost constant. The reduced upper/lower temperature deviation can improve a freshness of the food.

As has been explained, the method for controlling operation of a refrigerator of the present invention has the following advantages.

First, the reduction of the upper/lower temperature deviations ΔT 10 when the outside temperature is higher or lower than the standard temperature or the standard temperature range permits to improve a freshness of the food.

Second, the fixed turn on/off period 20 of the compressor regardless of the outside temperature permits to improve performance of the compressor and prevents reduction in a lifetime of the compressor.

It will be apparent to those skilled in the art that various modifications and variations can be made in the method for controlling operation of a refrigerator of the present invention without departing from the spirit or scope of the invention. Thus, it is intended that the present invention cover the modifications and variations of this invention provided they come within the scope of the appended claims and their equivalents.

What is claimed is:

1. A method for controlling operation of a refrigerator comprising the steps of:

turning on a compressor when a temperature of a food storage chamber reaches to an upper limit of upper/lower temperature deviations ΔT from an optimal setting temperature T;

turning off the compressor when the temperature of the food storage chamber reaches to a lower limit of upper/lower temperature deviations ΔT from the optimal setting temperature T; and varying the upper/lower temperature deviations ΔT with an outside temperature, wherein the variation of the upper/lower temperature deviations ΔT for a range of the outside temperature higher or lower than a standard temperature (a temperature set between 20° C.~30° C.) is set smaller than the variation of the upper/lower temperature deviations ΔT for a range of the outside temperature at the standard temperature.

2. A method for controlling operation of a refrigerator comprising the steps of:

turning on a compressor when a temperature of a food storage chamber reaches to an upper limit of upper/lower temperature deviations ΔT from an optimal setting temperature T;

turning off the compressor when the temperature of the food storage chamber reaches to a lower limit of upper/lower temperature deviations ΔT from the optimal setting temperature T; and varying the upper/lower temperature deviations ΔT with an outside temperature, wherein the variation of the upper/lower temperature deviations ΔT for a range of the outside temperature higher or lower than a standard temperature range (a temperature range of 20° C.~30° C.) is set smaller than the variation of the upper/lower temperature deviations ΔT for a range of the outside temperature at the standard temperature.

3. A method for controlling operation of a refrigerator comprising the steps of:

turning on a compressor when a temperature of a food storage chamber reaches to an upper limit of upper/lower temperature deviations ΔT from an optimal setting temperature T;

turning off the compressor when the temperature of the food storage chamber reaches to a lower limit of upper/lower temperature deviations ΔT from the optimal setting temperature T; and varying the upper/lower temperature deviations ΔT with an outside temperature, wherein the upper/lower temperature deviations are set such that the turn on/off period of the compressor is maintained constant regardless of the outside temperature.

4. A method for controlling operation of a refrigerator comprising the steps of:

turning on a compressor when a temperature of a food storage chamber reaches to an upper limit of upper/lower temperature deviations ΔT from an optimal setting temperature T;

turning off the compressor when the temperature of the food storage chamber reaches to a lower limit of upper/lower temperature deviations ΔT from the optimal setting temperature T;

varying the upper/lower temperature deviations ΔT with an outside temperature, and making realtime monitoring of the turn on/off period of the compressor, and finding an optimal upper/lower temperature deviations which can maintain the turn on/off period of the compressor constant and setting to a microcomputer.

* * * * *